US006386943B1

(12) United States Patent
Chang

(10) Patent No.: US 6,386,943 B1
(45) Date of Patent: May 14, 2002

(54) PUPPET LEGS MOVEMENT MECHANISM

(76) Inventor: Chao-Tsung Chang, No. 100, Kuang-Hui Street, Taichung City (TW)

( * ) Notice: Subject to any disclaimer, the term of this patent is extended or adjusted under 35 U.S.C. 154(b) by 0 days.

(21) Appl. No.: 09/718,081

(22) Filed: Nov. 22, 2000

(51) Int. Cl.[7] ..... A63H 13/00

(52) U.S. Cl. ..... 446/354; 446/330; 446/353; 446/352; 40/420

(58) Field of Search ..... 446/352, 353, 446/354, 355, 356, 377, 330; 40/414, 418, 419, 420

(56) References Cited

U.S. PATENT DOCUMENTS 3,060,631 A * 10/1962 Collischan ..... 446/301
4,177,602 A * 12/1979 Choi ..... 446/356
4,582,499 A * 4/1986 Saigo et al. ..... 446/352
4,622,020 A * 11/1986 Amieci et al. ..... 446/353
4,813,908 A * 3/1989 Oikawa et al. ..... 446/353
4,840,242 A * 6/1989 Chih et al. ..... 446/356
5,842,906 A * 12/1998 Terzian et al. ..... 446/330
6,244,924 B1 * 6/2001 Liu ..... 446/352

* cited by examiner

*Primary Examiner*—Jacob K. Ackun
*Assistant Examiner*—Urszula M. Cegielnik
(74) *Attorney, Agent, or Firm*—Charles E. Baxley

(57) ABSTRACT

A puppet mechanism for moving two legs of a puppet includes an output shaft rotatably extending from a gear box and engaged with a gear reduction device in the gear box. Two disks are respectively connected two ends of the output shaft and each disk has an eccentric protrusion extending therefrom. Two swing members are pivotally connected to two sides of the gear box and each swing member has a slot in which the eccentric protrusion is movably engaged. The swing members are inserted in the two legs of the puppet and are swung when the disks rotate.

5 Claims, 6 Drawing Sheets

PUPPET LEGS MOVEMENT MECHANISM

FIELD OF THE INVENTION

The present invention relates to a mechanism for a puppet and controls two legs of a puppet to move one by one.

BACKGROUND OF THE INVENTION

A conventional toy or puppet is required to have a feature of being able to move its limbs so as to attract the children. A proper mechanism is installed in the puppet and includes multiple links which are able to swing or move. The conventional mechanism occupies a large space and involves too many parts so that it is difficult to make a small and interesting puppet. Although some mechanisms have developed to have a compact size, they can only perform simple and un-natural action.

The present invention intends to provide a mechanism which employs eccentric mechanism to reciprocatingly swing two legs of a puppet.

SUMMARY OF THE INVENTION

In accordance with one aspect of the present invention, there is provided a puppet mechanism for moving two legs of the puppet and comprising a gear box having a gear reduction device received therein which is driven by a motor. An output shaft rotatably extends from the gear box and is engaged with the gear reduction device. Two disks are respectively connected two ends of the output shaft and each disk has an eccentric protrusion extending therefrom. Two swing members each are pivotally connected to the gear box at a mediate point thereof and a slot is defined through a first end thereof so that the two eccentric protrusions are respectively engaged with the slots of the two swing members. A second end of each swing member is connected to respective one of two legs of the puppet.

The primary object of the present invention is to provide a mechanism that employs rotatable eccentric protrusions to let two swing members swing and the two swing members are mounted by two legs of the puppet.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
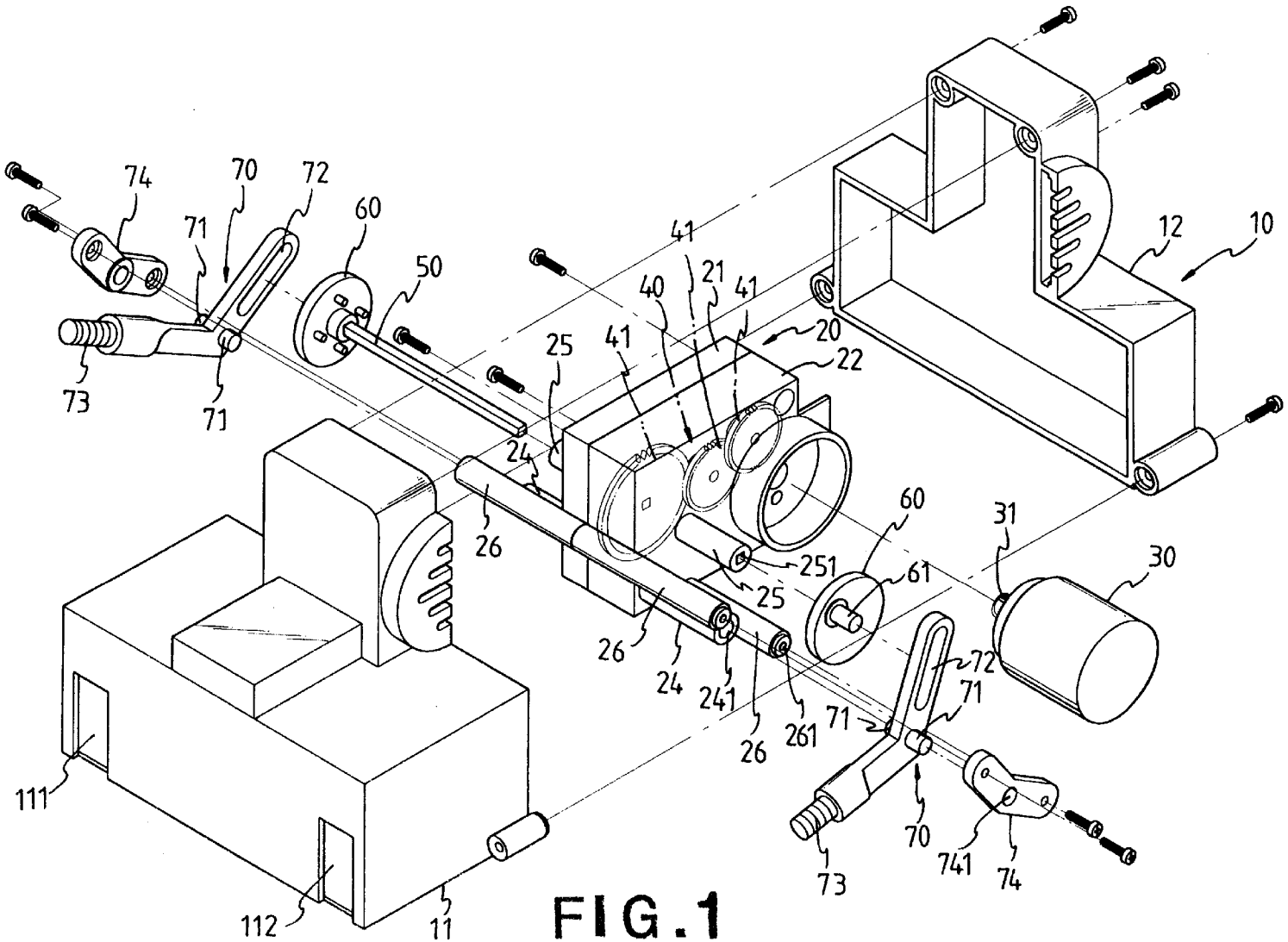
FIG. 1 is an exploded view to show a puppet mechanism for moving two legs of the puppet of the present invention.
Figure 2:
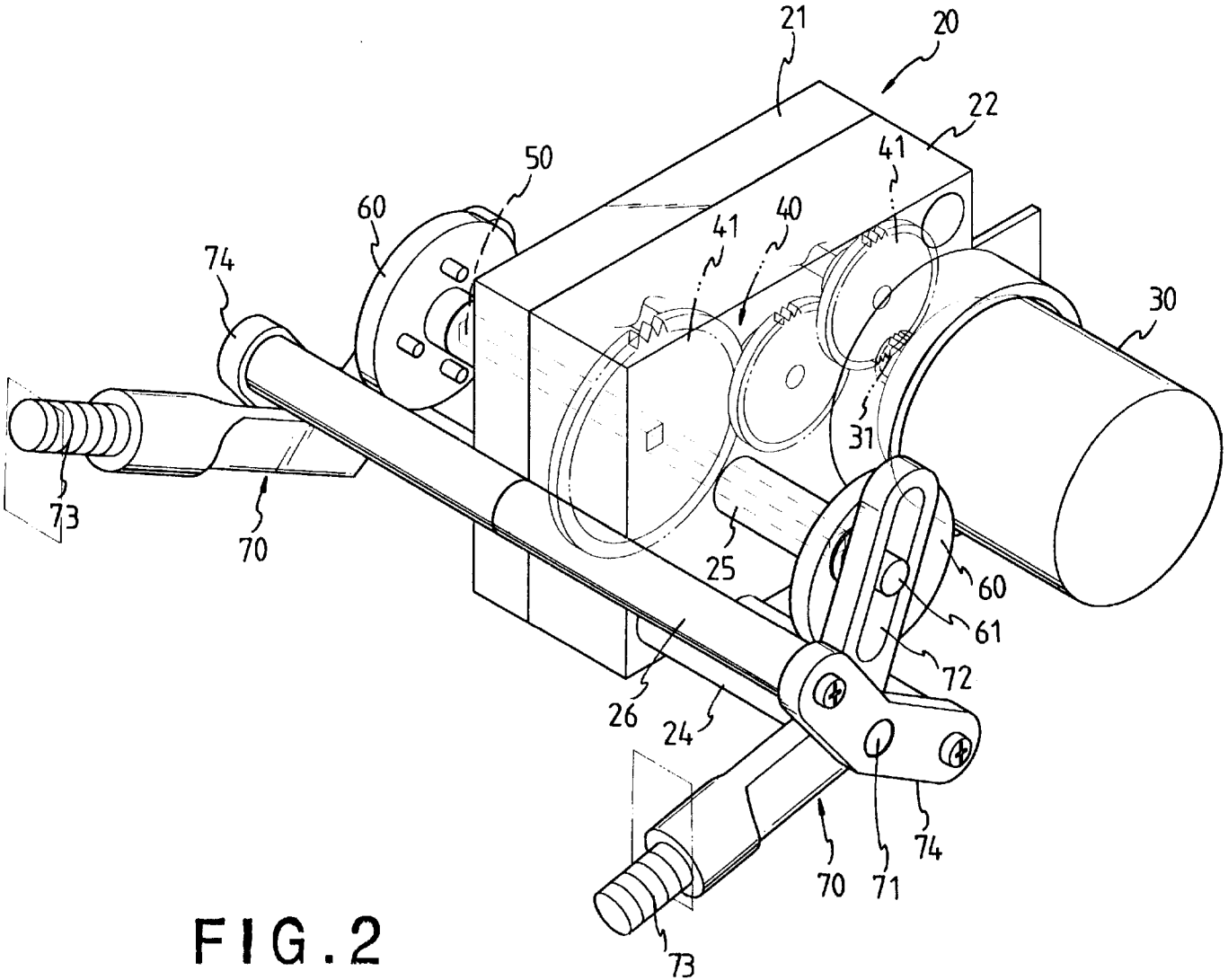
FIG. 2 is a perspective view to show the mechanism of the present invention.
Figure 6:
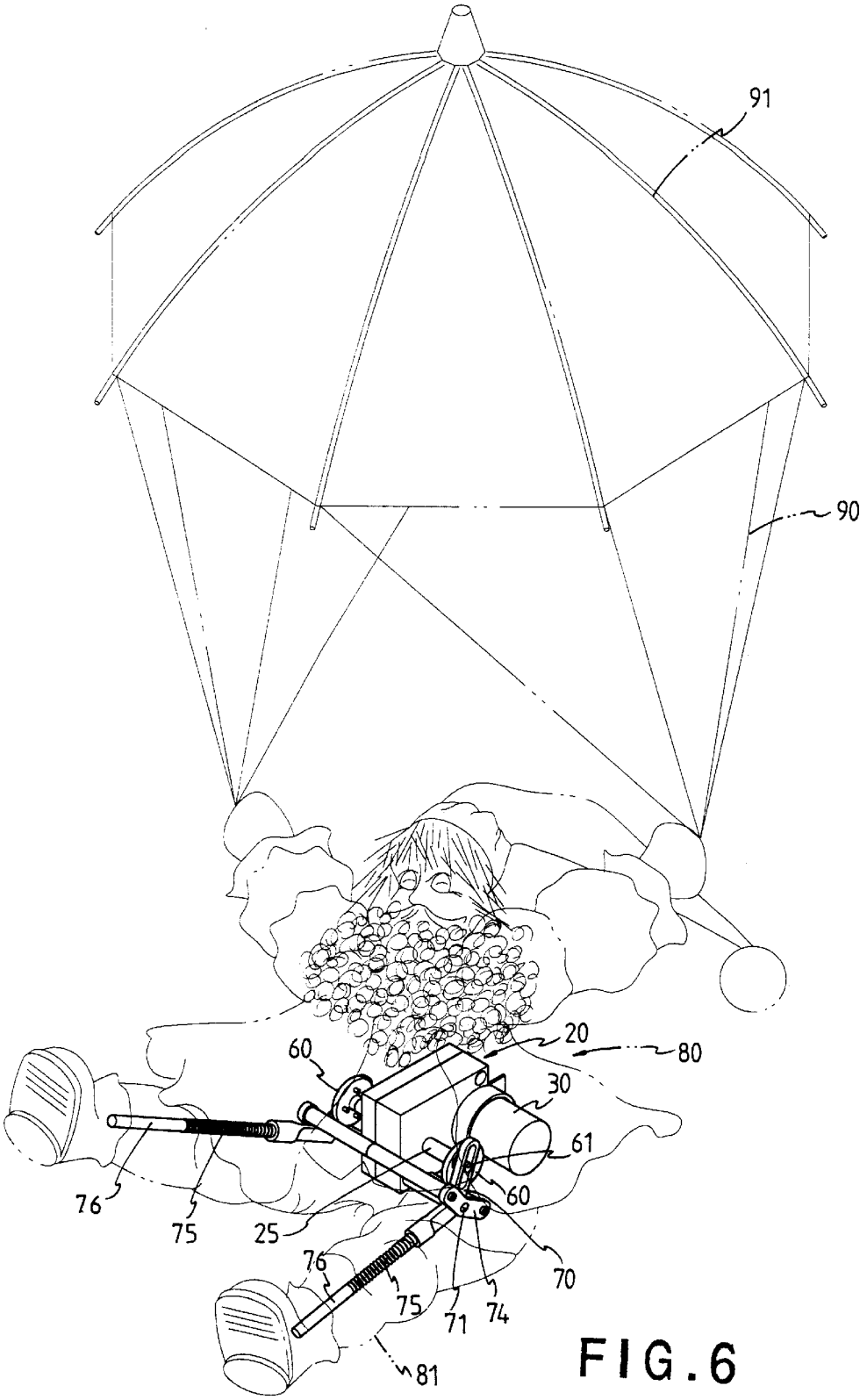
FIG. 6 is a perspective view to show a puppet is hanged by wires and an parachute.

Referring to FIGS. 1 and 2, the mechanism for moving two legs 81 (as shown in FIG. 6) of a puppet 80 of the present invention comprises a gear box 20 which is composed of two halves 21, 22, and a gear reduction device 40 is received in the gear box 20. A motor 30 having a shaft 31 which is connected to the gear reduction device 40 and drives one of the gears 41 of the gear reduction device 40, and an output shaft 25 rotatably extends from the gear box 20 and is engaged with another gear 41 of the gear reduction device 40. The output shaft 25 has a rectangular passage 251 defined longitudinally therethrough and a bar 50 having a rectangular cross section extends through the passage 251. Two disks 60 are connected to two ends of the bar 50 and each disk 60 has an eccentric protrusion 61 extending therefrom.

Two positioning tubes 26 and a pivot tube 24 respectively extend from each one of two sides of the gear box 20. Two swing members 70 each have two pivot rods 71 extending from two opposite sides thereof and the swing members 70 are pivotally connected to the gear box 20 at a mediate point thereof. A slot 72 is defined through a first end of each swing member 70 and the two eccentric protrusions 61 are respectively engaged with the slots 72 of the two swing members 70. A second end 73 of each swing member 70 is connected to a first end of a spring 75 and a second end of the spring 75 is connected to an extension rod 76. The swing member 70, the spring 75 and the extension rod 76 are mounted by one leg 81 of the puppet 80 and the spring 75 allows the extension rod 76 to be bent like a leg portion bends by the knee. The swing members 70 are pivotally connected to the tow pivot tubes 24 by inserting one of the two pivot rods 71 in the pivot tube 24. Two plates 74 are respectively located on the two sides of the gear box 20 and each have two ends connected to two positioning tubes 26. A hole 741 is defined through a mediate portion of each plate 74 and the other pivot rod 71 of each swing member 70 is inserted in the hole 741.

A casing 10 composed by two parts 11, 12 receives the gear box 20, two swing members 70 and the motor 30 therein. Two apertures 111, 112 are defined through an end of the casing 10 and the two respective second ends 73 of the swing members 70 extending through the two apertures 111, 112.

Figure 3:
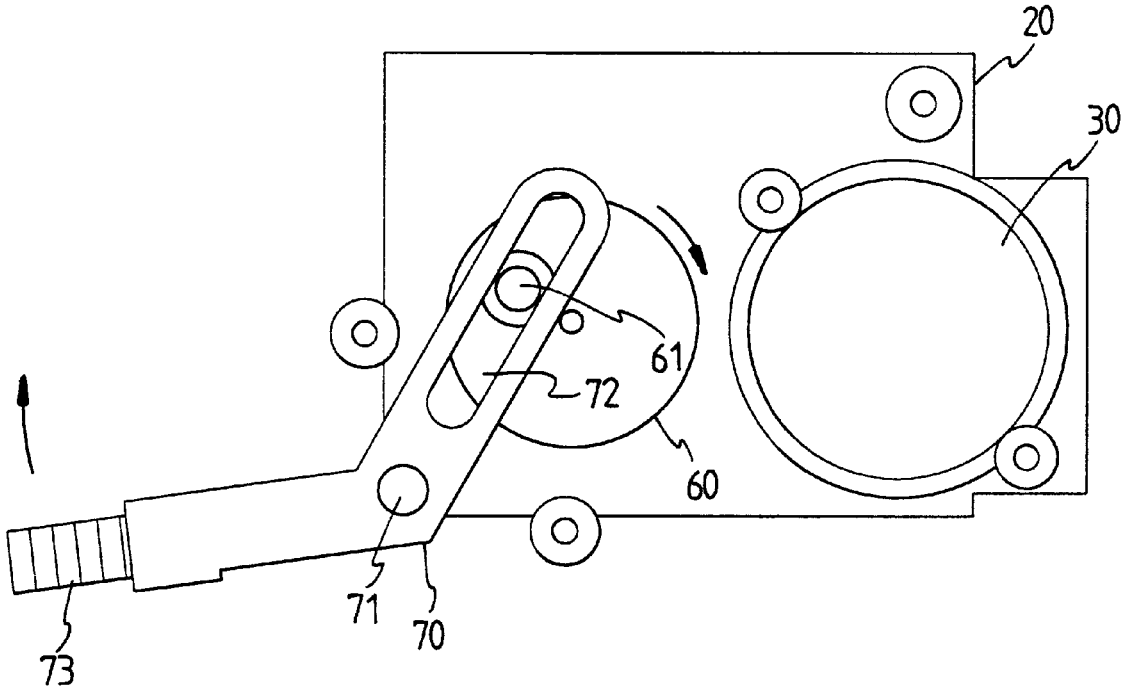
FIGS. 3 and 4 respectively show the swing member is pivoted clockwise when the disk with an eccentric protrusion is rotated.
Figure 4:
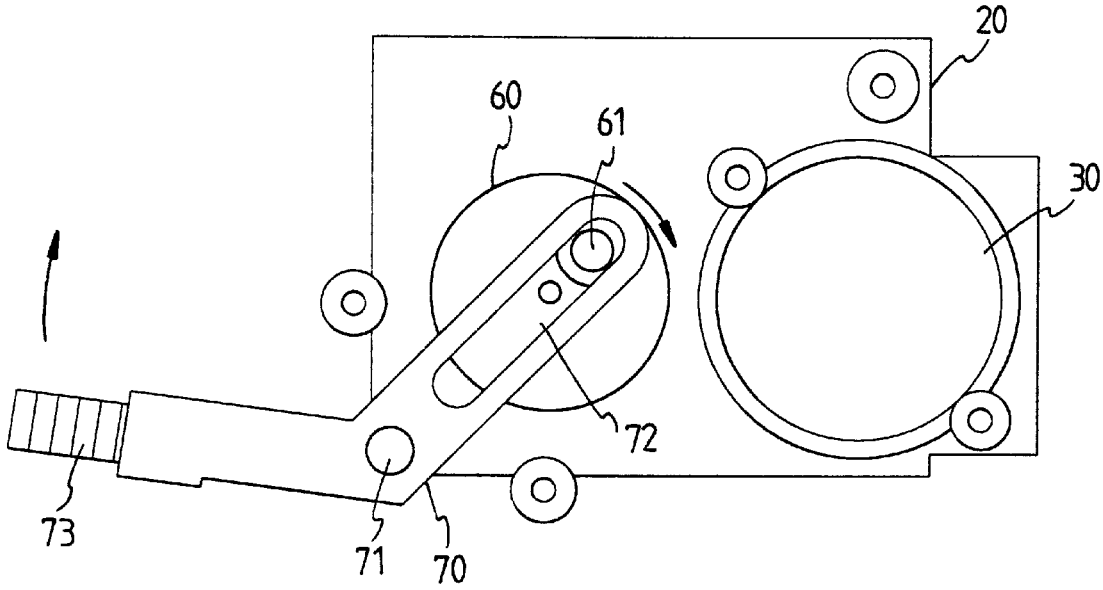
Figure 5:
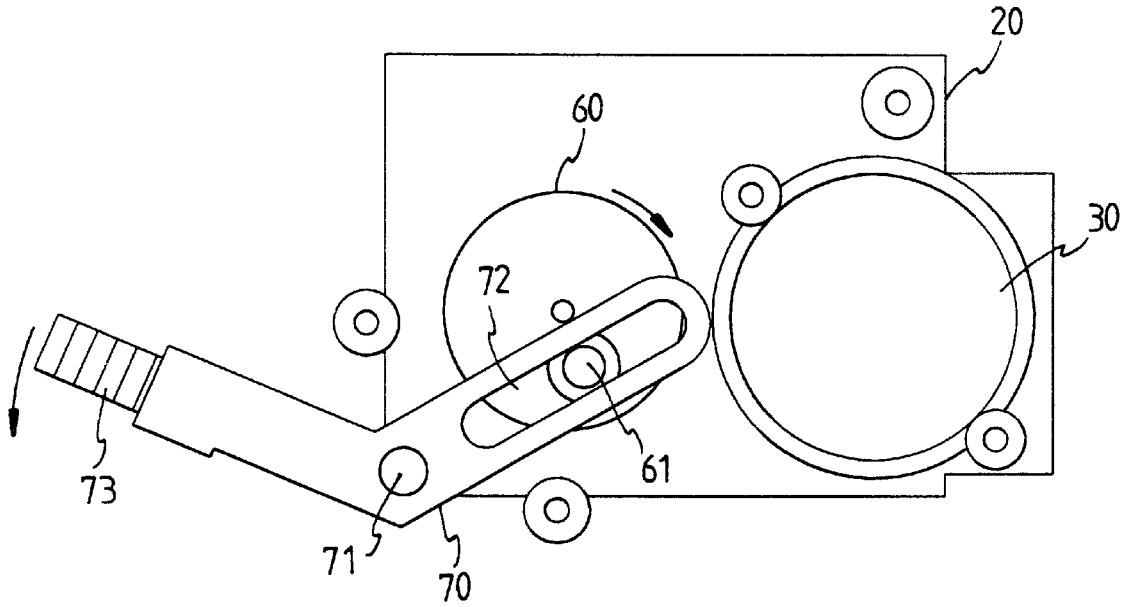
FIG. 5 shows the swing member is pivoted counter clockwise when the disk with the eccentric protrusion is rotated.

The puppet 80 is hanged by wires 90 and an parachute 91 as shown in FIG. 6 and the legs 81 are moved and bent when the motor 30 is operated. A shown in FIGS. 3 to 5, when the motor 30 is operated, the eccentric rods 61 is rotated together with the disks 60 and the eccentric rods 61 are movably in the slots 72 so as to pivot the swing members 70 about the pivot rods 71. Therefore, the legs 81 of the puppet 80 are moved as it walks. The positions of the eccentric rods 61 can be managed to let the legs 81 move alternatively or simultaneously.

While we have shown and described various embodiments in accordance with the present invention, it should be clear to those skilled in the art that further embodiments may be made without departing from the scope and spirit of the present invention.

What is claimed is:

1. A puppet mechanism for moving two legs of a puppet, comprising:

a gear box having a gear reduction device received therein and a motor connected to said gear reduction device, an output shaft rotatably extending from said gear box and engaged with said gear reduction device, two disks respectively connected to ends of said output shaft and each disk having a protrusion extending eccentrically therefrom, and two swing members each pivotally connected to said gear box at a mediate point thereof and a slot defined through a first end of each swing member, said two protrusions respectively engaged with said slots of said two swing members, a second end of each swing member connected to a first end of a spring and a second end of said spring connected to an extension rod, said second end of each swing member adapted to be connected to respective one of the two legs of the puppet.

2. The mechanism as claimed in claim 1 further comprising two positioning tubes and a pivot tube respectively extending from each one of two sides of said gear box, two pivot rods extending from two opposite sides of each swing member and said two swing members pivotally connected to said two pivot tubes by inserting one of said two pivot rods in said pivot tube, two plates located on said two sides of said gear box and each having two ends connected to two positioning tubes, a hole defined through a mediate portion of each plate and the other pivot rod of each swing member inserted in said hole.

3. The mechanism as claimed in claim 1 further comprising a casing which receives said gear box and said motor therein, two apertures defined through an end of said casing and said two respective second ends of said swing members extending through said two apertures.

4. The mechanism as claimed in claim 1 wherein said output shaft has a rectangular passage defined longitudinally therethrough and a bar having a rectangular cross section extending through said passage, said two disks connected to two ends of said bar.

5. The mechanism as claimed in claim 4, wherein said bar engaged with said gear reduction device.

* * * * *